US010112211B2

(12) United States Patent
Frenkel et al.

(10) Patent No.: US 10,112,211 B2
(45) Date of Patent: Oct. 30, 2018

(54) PAINTING APPARATUS COMPRISING AN AIR BAG

(71) Applicant: NIRLAT LTD, D.N. Negev (IL)

(72) Inventors: Oded Frenkel, Hod-Hasharon (IL); Oren Moshe, Bat Hefer (IL); Shiri Zakai, Hod Hasharon (IL); Juda Kaplun, Kibutz Nirim (IL); Tami Marcovich, Kochav-Yair (IL); Boris Grinspan, Kibutz Sde-Yoav (IL); Ben Josef Yehuda, Mosav Ein Habsor (IL); Tal Leizer, Shefayim (IL); Shlomi Eiger, Cfar Saba (IL); Roi Vaspi Yanai, Tel Aviv (IL); Meir Bareli, Kiryat-Ata (IL); Amichai Yifrach, Kedumim (IL)

(73) Assignee: NIRLAT LTD, Kibbutz Nir Oz (IL)

( * ) Notice: Subject to any disclaimer, the term of this patent is extended or adjusted under 35 U.S.C. 154(b) by 167 days.

(21) Appl. No.: 14/957,633

(22) Filed: Dec. 3, 2015

(65) Prior Publication Data

US 2016/0158793 A1 Jun. 9, 2016

Related U.S. Application Data

(63) Continuation-in-part of application No. 14/558,759, filed on Dec. 3, 2014.

(51) Int. Cl.

| | |
|---|---|
| ***B67D 3/04*** | (2006.01) |
| ***B67D 7/02*** | (2010.01) |
| ***B05C 17/03*** | (2006.01) |
| ***B65D 47/24*** | (2006.01) |
| ***B05B 9/08*** | (2006.01) |

(52) U.S. Cl.

CPC ..... *B05C 17/0341* (2013.01); *B05B 9/0811* (2013.01); *B05B 9/0816* (2013.01); *B05B 9/0838* (2013.01); *B05C 17/0316* (2013.01); *B65D 47/249* (2013.01); *B67D 3/047* (2013.01); *B67D 7/0294* (2013.01); *B05B 9/0888* (2013.01); *B05C 17/0308* (2013.01)

(58) Field of Classification Search

None

See application file for complete search history.

(56) References Cited

U.S. PATENT DOCUMENTS 3,195,170 A * 7/1965 Howard ..... B05C 17/002 401/146
3,702,739 A * 11/1972 Rentfrow ..... B05C 17/0325 401/197
3,933,415 A 1/1976 Woolpert (Continued)

FOREIGN PATENT DOCUMENTS

DE 20 2009 013502 12/2009
WO 2010/063854 6/2010

*Primary Examiner* — Binu Thomas

(74) *Attorney, Agent, or Firm* — Soroker Agmon Nordman

(57) ABSTRACT

The subject matter discloses a faucet inserted into a paint port of a painting apparatus to control flow of paint removed from the painting apparatus, the faucet comprising an external mold rotatably insertable into a paint port of a painting apparatus; wherein said external mold is spiral; an internal mold insertable into the external mold; a faucet valve to control flow of paint from the paint apparatus.

6 Claims, 15 Drawing Sheets

(56) References Cited

U.S. PATENT DOCUMENTS

| | | | | | |
|---|---|---|---|---|---|
| 4,231,668 | A * | 11/1980 | Groth | B05C 11/11 | 401/146 |
| 4,601,410 | A * | 7/1986 | Bond | B65B 61/186 | 222/105 |
| 4,639,156 | A * | 1/1987 | Stern | B05C 17/002 | 401/146 |
| 4,696,411 | A * | 9/1987 | Graf | B01J 4/001 | 222/81 |
| 5,511,692 | A * | 4/1996 | Willingham | B67D 1/0802 | 222/400.7 |
| 5,816,331 | A * | 10/1998 | Vivier | A62C 13/76 | 169/30 |
| 5,884,648 | A * | 3/1999 | Savage | B67D 7/0294 | 137/1 |
| 6,299,027 | B1 * | 10/2001 | Berge | B65D 47/248 | 222/153.14 |
| 6,843,285 | B2 * | 1/2005 | Ozawa | B67D 1/0835 | 141/346 |
| 2002/0074533 | A1 * | 6/2002 | DeCler | B67D 3/045 | 141/346 |

* cited by examiner

PAINTING APPARATUS COMPRISING AN AIR BAG

FIELD OF THE INVENTION

The subject matter relates generally to a painting apparatus enabling even distribution of paint onto a surface.

BACKGROUND OF THE INVENTION

A paint roller is well known in the art for painting objects and structures, for example a wall of a house. The roller requires paint to be distributed along the roller to enable painting an even coat over the object that is being painted. Various apparatuses have been created to better distribute the paint on the roller from a paint bag. For example, a roller that comprises a motor that pumps paint from a paint bag. In some cases, the roller comprises a button that is used to pour the paint onto the roller through a pipe. Some painting devices enable squeezing a paint tube in which the paint is stored. The paint tube compresses causing the paint inside to flow out and onto a paint roller or paint brush.

SUMMARY

It is an object of the object matter to disclose a faucet inserted into a paint port of a painting apparatus to control flow of paint removed from the painting apparatus, the faucet comprising an external mold rotatably insertable into a paint port of a painting apparatus; wherein said external mold is spiral; an internal mold insertable into the external mold; a faucet valve to control flow of paint from the paint apparatus.

In some cases, the faucet further comprises a paint roller, wherein the faucet valve control flow of paint from the paint apparatus to the paint roller.

In some cases, the faucet valve is rimmed to prevent the paint tube slipping off of the faucet valve.

In some cases, a paint tube is connected to the faucet opening to enable paint to flow from the painting apparatus to the paint roller.

In some cases, the paint roller is configured for painting a surface, said paint roller comprising a roller cage to attach a foam roll and enable painting; a handle to enable the user to hold the paint roller; a paint roller connecter which receives paint from a painting apparatus; a frame connecting the roller cage to the handle; said frame comprising a frame tube to enable paint to flow from the handle to the roller cage; a flow controller for controlling an amount of paint flowing from the paint roller connector to the foam roll; a dispensing port to distribute paint onto the foam roll.

In some cases, the faucet further comprises a removable portion to prevent the faucet lever from opening prior to a first use of the painting apparatus.

In some cases, the external mold comprises one or more handles to provide a grip for a user to rotate the faucet.

In some cases, the internal mold is inserted into the external mold during production of the painting apparatus.

In some cases, the material composing the faucet prevents the paint from sticking to the walls of the paint bag of the painting apparatus.

In some cases, the material composing the faucet enables welding the faucet onto the painting apparatus.

In some cases, the faucet may be comprised of a disposable material, and may be disposable, e.g. enabling a single use or multiple uses of the painting apparatus and the faucet.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

DETAILED DESCRIPTION

The subject matter relates generally to a painting apparatus enabling distribution of paint onto a surface, according to exemplary embodiments.

One technical problem dealt by the disclosed subject matter is providing a paint accessory, such as a paint roller with paint, without the need to dip the paint roller into a paint source, such as a paint bucket, while painting a surface. Another technical problem dealt with the disclosed subject matter is providing a paint accessory with continuous paint flow from a paint source. Yet another technical problem dealt with the disclosed subject matter is providing a paint source that can provide paint to a paint accessory on demand.

One technical solution according to the disclosed subject matter is a painting apparatus, which comprises the paint accessory connected to the painting apparatus. The painting apparatus comprises a paint bag having a tube attached thereto, to convey the paint from the paint bag to the paint accessory. The painting apparatus also comprises an air bag attached or connected to the paint bag, such that when air is delivered into the air bag the expansion of the air bag results in pressure onto the paint bag, forcing paint to exit the paint bag through a paint tube, the paint flows towards the paint accessory. A user of the painting apparatus controls an air pump to pump air into the air bag. Alternatively, air or another gas is pumped into the paint bag automatically.

Figure 1:
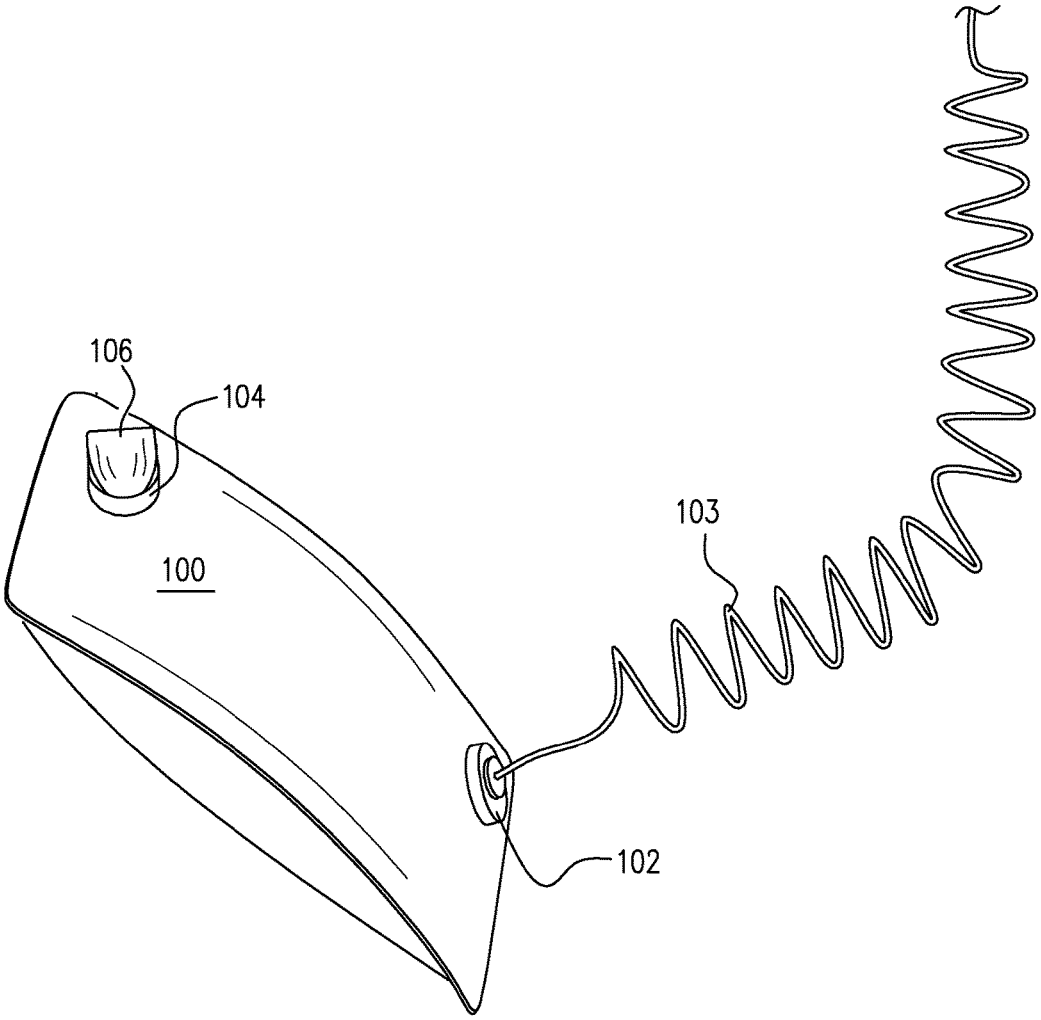
FIG. 1 shows a painting apparatus, according to some exemplary embodiments of the subject matter.

FIG. 1 shows a painting apparatus, according to some exemplary embodiments of the subject matter. The painting apparatus 100 preferably comprises two bags (not shown), a paint bag, which stores paint that is used to paint a surface, and an air bag, which in operation would receive a gas, such as air, said gas will increase the size of the air bag. Since the painting apparatus has a limited ability to expand, the expansion of the air bag will result in pressure being applied to the paint bag. The painting apparatus 100 comprises a paint port 102, through which paint exits the painting bag. In accordance with some embodiments of the subject matter, the paint port 102 is connected to a paint tube 103 through which paint flows from the paint port 102 to a paint accessory (not shown). The paint accessory distributes paint along a surface, for example a wall. In some exemplary embodiments of the subject matter, the paint accessory is a paint roller, a paint brush, a paint spraying device, some other paint distributing apparatus, or the like. The paint bag of the painting apparatus 100 is preferably composed of a flexible plastic material, which enables compression of the painting apparatus 100 to force paint out of the paint bag through the paint port 102. When the paint exits the paint port 102 it flows through the paint tube 103 onto the paint accessory. In some exemplary embodiments of the subject matter, the paint tube 103 may be disconnected from the painting apparatus 100 in order for maintenance and cleaning to enable long use of the painting apparatus 100 with different colors.

The painting apparatus 100 preferably comprises therein an air bag (not shown) which is used for providing pressure on the paint bag, thus allowing a flow of paint from the paint bag through the paint port 102. According to this embodiment, it is the expansion of the air bag that causes the contraction of the paint bag and the flow of paint therefrom to the paint accessory. Person skilled in the art will appreciate that any other mechanism, which can apply contraction force on the paint bag can be used in the alternative to drive the paint out of the paint bag. The air bag is preferably composed of an elastic material such as elastic polymer, rubber, or any other elastic material that enables the air bag to expand when gas, such as air is pumped there into. The air bag therefore acts as a balloon expanding while the air volume therein increases and applying pressure to the paint bag. The air bag is partially or fully attached to the paint bag, for example having a mutual sidewall or another shared surface (not shown). When air is pumped into the air bag, the air bag expands and applies pressure onto the paint bag. If the paint port 102 is open, paint will flow from the paint bag through the paint tube 103. The air bag further comprises an air port 104 through which air enters the air bag. In some exemplary embodiments of the subject matter, the air port 104 is connected to a pumping mechanism 106, which pumps air into the air bag. The pumping mechanism can be mechanical, electrical, motorized, manual or the like device for pushing air into the air bag. In some exemplary embodiments, the pumping mechanism 106 is mechanical and is activated by a motor (not shown). In some cases, a unidirectional valve (not shown) is disposed onto the air port 104 or between the pumping mechanism 106 and the air port 104, to prevent the air from exiting the air bag 116. In some cases, a sensor (not shown) is disposed between the pumping mechanism 106 and the interior side of the air bag 116, to measure the gas pressure within the air bag 116. The pumping mechanism 106 is activated when the gas sensor of the pumping mechanism 106 receives indication that the gas pressure within the air bag is below a predetermined level. In other cases, the sensor can be disposed within the pumping mechanism 106.

The paint bag and the air bag may be of different sizes, according to the necessity of the user. For example, where the user of the painting apparatus 100 is painting a wall of a house, the paint bag may have a capacity to hold at least one liter of paint. The air bag would have to be of a size that would enable a fully inflated air bag to substantially empty the paint bag. According to such embodiment, the air bag will be comprised of sufficient flexible material enabling it to expand such that most or nearly all of the paint in the paint bag can be squeezed out therefrom.

Figure 2:
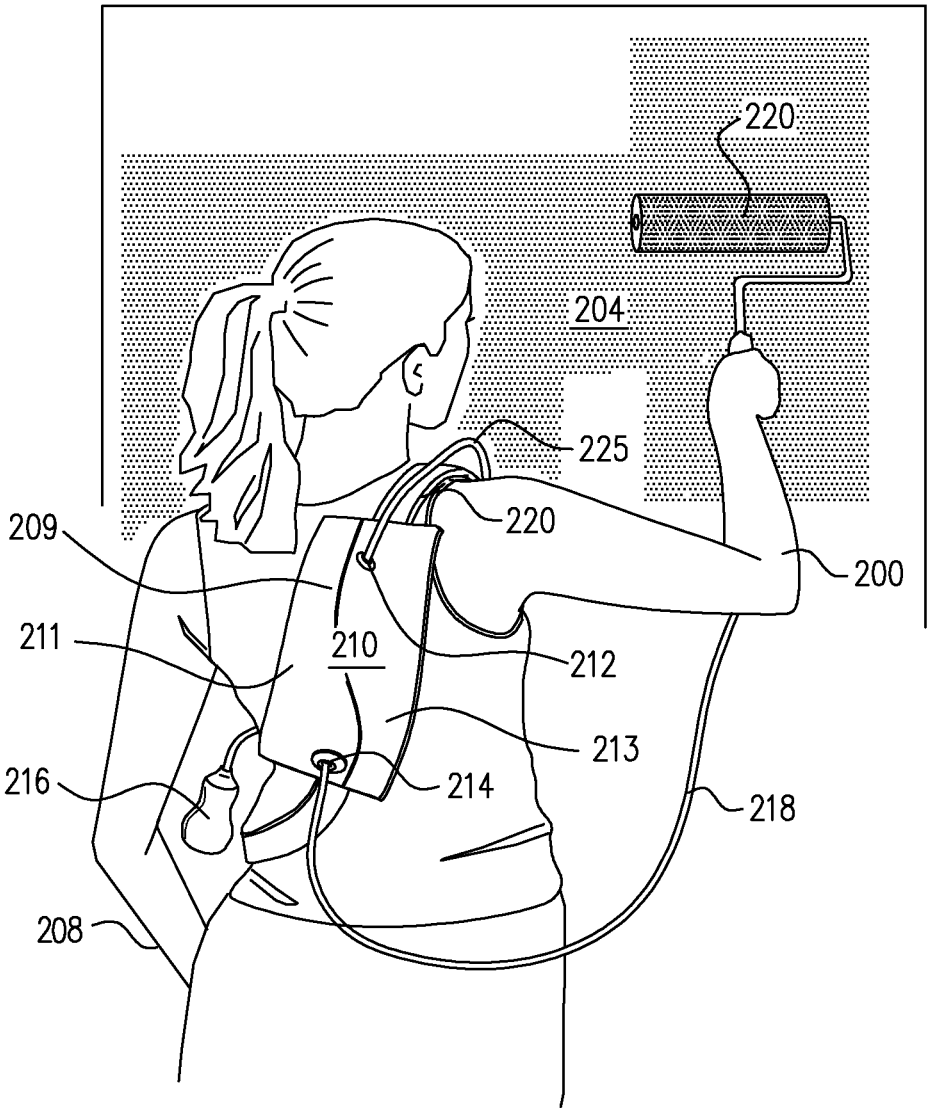
FIG. 2 shows a user using a painting apparatus, according to some exemplary embodiments of the subject matter.

FIG. 2 shows a user using a painting apparatus, according to some exemplary embodiments of the subject matter. The user 200 of the painting apparatus 210 carries the painting apparatus 210, for example, on the user's back. In other embodiments of the subject matter, the painting apparatus can be worn with a strap on the waist or on a limb or placed next to the user 200. The painting apparatus 210 comprises shoulder straps 202 that the user 200 wears when carrying the painting apparatus 210. The user 200 holds a paint accessory 220, for example a paint roller, connected to the painting apparatus 210 in her hand 208 via a paint tube 218. The paint accessory 220 is pressed against a surface 204, such as a wall, to distribute paint onto the surface 204. As seen in FIG. 2, a pumping mechanism 216, such as it mechanical pump having a squeezing or pressing element, is used to introduce air into the painting apparatus 210. In action the pumping action is performed when the user's presses the pumping mechanism 216, and air is pumped through air port 212 into an air bag 213. As the air enters the air bag 213, the air bag 213 expands applying pressure on a paint bag 211 of the painting apparatus 210. As the paint bag 211 is compressed by the expansion of the air bag 213 paint exits through a paint port 214. The paint flows from the paint port 214 through a paint tube 218 to the paint accessory 220. In the present FIG. 2, air bag 213 and paint bag 211 are shown and for the purpose of explanation are divided by figurative line 209, though in practice the air bag 213 and paint bag 211 will be provided within painting apparatus 210, and while air bag 213 increases in size, paint bag 211 will decrease in size as paint is pushed out therefrom through paint port 214.

Using gas, such as air, to control the flow of paint to the paint accessory 220 enables the continuous painting with the paint accessory 220 while providing paint such that the user 200 does not have to stop painting in order to apply paint onto the paint accessory 220. The painting environment is cleaner and does not require carrying around heavy equipment such as paint buckets and trays, which are bulky, messy and heavy.

In some exemplary embodiments of the subject matter, the pumping mechanism 216 may employ a mechanical force. In some other cases, the pumping mechanism 216 may be a lever (not shown), which the user 200 of the painting apparatus 210 moves or pushes to pump gas into the air bag 213. In some exemplary cases, the pumping mechanism 216 comprises a pump, such as a balloon nozzle which may be operated using the user's limb. When the pumping mechanism 216 is pressed or squeezed, gas, such as air is pumped into a control tube 225 through openings (not shown), which are located on the control tube 225. When the pumping mechanism 216 is pressed, the openings allow gas to enter the control tube 225 and to flow into the air bag 213. In some other embodiments of the present subject matter the control tube 225 may be constructed so as to limit the amount of gas which is pumped into the air bag 213 so as to avoid excessive pressure applied to the paint bag 211. The gas entering the air bag 213 causes the air bag 213 to expand, which compresses the paint bag 211. The compression of the paint bag 211 causes paint to be pushed out of the paint bag 211 into the paint tube 218 towards the paint accessory 220.

Figure 3A:
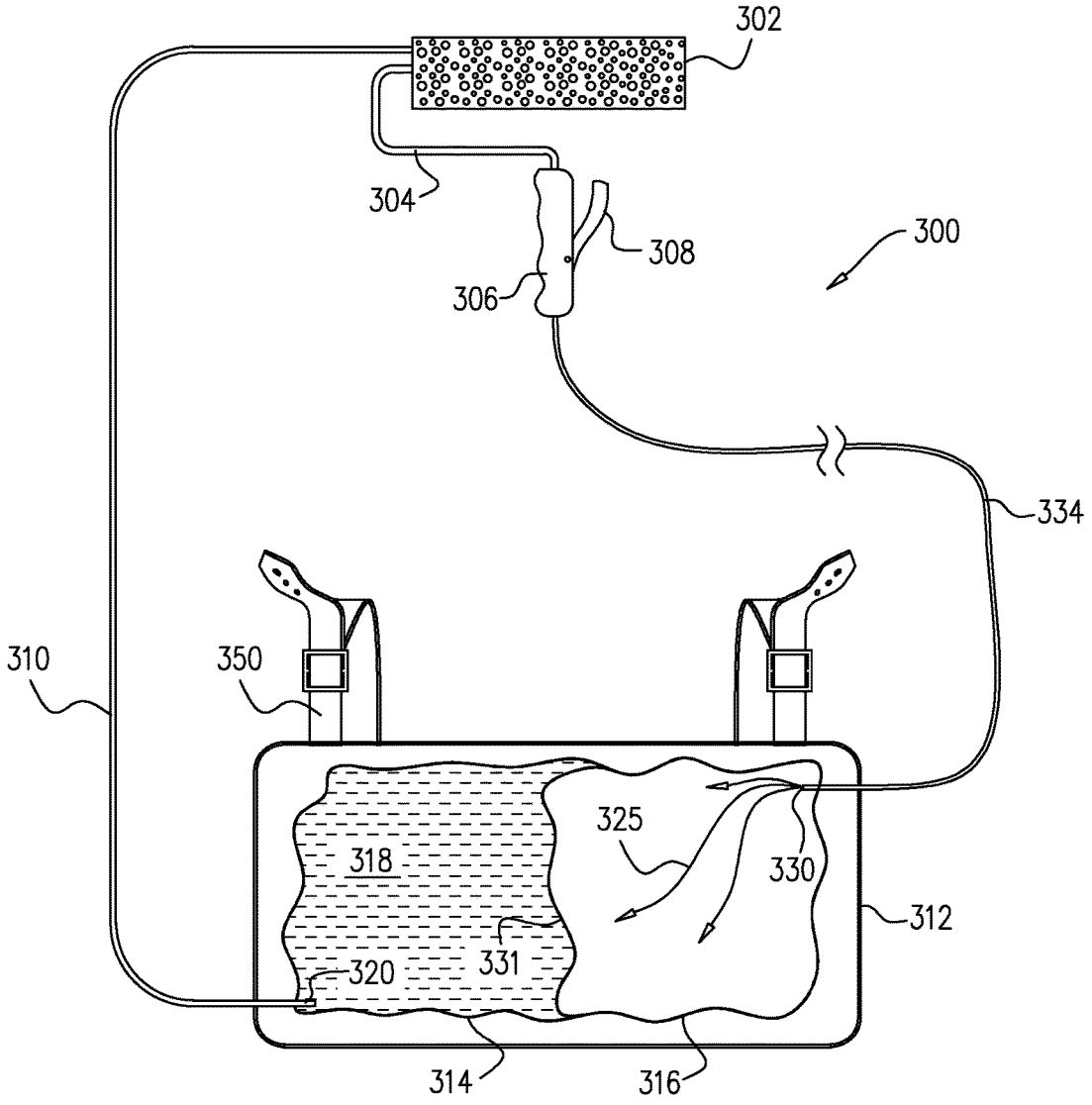
FIG. 3A-3B show a painting apparatus, according to some exemplary embodiments of the subject matter.

FIG. 3A shows a schematic painting apparatus, according to some exemplary embodiments of the subject matter. The painting apparatus 300 comprises a paint accessory 302, which distributes paint along a surface, for example a wall. For example, the paint accessory is a paint roller, paint brush, or the like. The paint accessory 302 is connected to a handle 306 by a connector 304. The handle 306 is used by a user of the painting apparatus 300 when painting an object. In some cases, the paint accessory 302 may be disconnected from the painting apparatus 300 and replaced with a different paint accessory. For example, a user of the painting apparatus 300 is using a paint roller to paint large areas on a surface and then removed the paint roller and connects a paint brush to the painting apparatus to perform finishing touches such as corners. The painting apparatus 300 comprises a compartment 312 that comprises a paint bag 314. The paint bag 314 is composed out of an elastic polymer such as elastic plastic, rubber, or any other elastic materials. The paint bag 314 comprises paint 318, such as acrylic paint, oil based paint, wood protective paint, or the like. A paint tube 310 connects the paint bag 314 to the paint accessory 302. The paint tube 310 is composed of a flexible polymer material. In some exemplary embodiments of the subject matter, the paint tube 310 may be disconnected from the painting apparatus 300 in order for maintenance and cleaning to enable long use of the painting apparatus 300 with different colors. The paint tube 310 comprises a paint tube opening 320 through which the paint 318 enters the paint tube 310 to flow to the paint accessory 302. The compartment 312 further comprises an air bag 316, which is used for holding a gas 325. The air bag 316 is composed out of an elastic polymer such as an elastic polymer, rubber, or any other elastic material that enables the air bag 316 to expand when gas 325 is pumped into the air bag 316, such that it may frilly expand to provide such pressure that will force substantially all of the paint 318 from paint bag 314. In some embodiments of the subject matter, the air bag 316 and paint bag 314 are both located within compartment 312 but are separated one from the other. In some other embodiments of the subject matter the air bag 316 may be attached to a part or the whole or part of one or more of the walls of compartment 312. In some embodiments of the subject matter the paint bag 314 may be attached to a part or the whole or part of one or more of the walls of compartment 312. In other embodiments of the subject matter, the air bag 316 is connected or partially connected to the paint bag 314, for example having a mutual portion or whole side wall or another shared surface 331. It will be understood that any attachment material can be used and any form of attachment between the bags and/or walls can be used so as to best achieve the goals of the subject matter. When gas is pumped into the air bag, results in the air bag 316 expending and pressure is applied onto the paint bag 314. The paint bag 314 will then compress and decrease in size as a result and paint 318 is squeezed or forced out of the paint bag 314 through the paint tube opening 320. In some cases, a unidirectional valve 330 is disposed in the control tube 334, preventing the gas 325 from exiting the air bag 316 after it has been pumped there into.

In some cases, the handle 306 comprises a mechanical pumping mechanism 308, which when pressed by the user of the painting apparatus 300 causes the gas 325 to be pumped into the air bag 316. The pumping mechanism may work mechanically. In some other cases, the mechanical pumping mechanism 308 may be a lever, which the user of the painting apparatus 300 presses to pump the gas 325 into the air bag 316. In yet other exemplary cases, the pumping mechanism comprises a pump (not shown) having a balloon nozzle, which may be operated using the user's hand or foot. The mechanical pumping mechanism 308 is connected to the air bag 316 by a control tube 334, which pushes gas 325 into the air bag 316. When the pumping mechanism 308 is pressed, gas 325 is pumped into the control tube 334 through openings (not shown), which are located on the control tube 334 allowing gas 325 to enter the control tube 334 and to flow into the air bag 316. The gas 325 entering the air bag 316 causes the air bag 316 to expand, which compresses the paint bag 314. The compression of the paint bag 314 causes paint to be pushed out of the paint bag 314 into the paint tube 310 towards the paint accessory 302. As is further described in connection with other embodiments of the subject matter, in yet other embodiments, the pumping mechanism 308 is operated by a motorized pump (not shown).

Figure 3B:
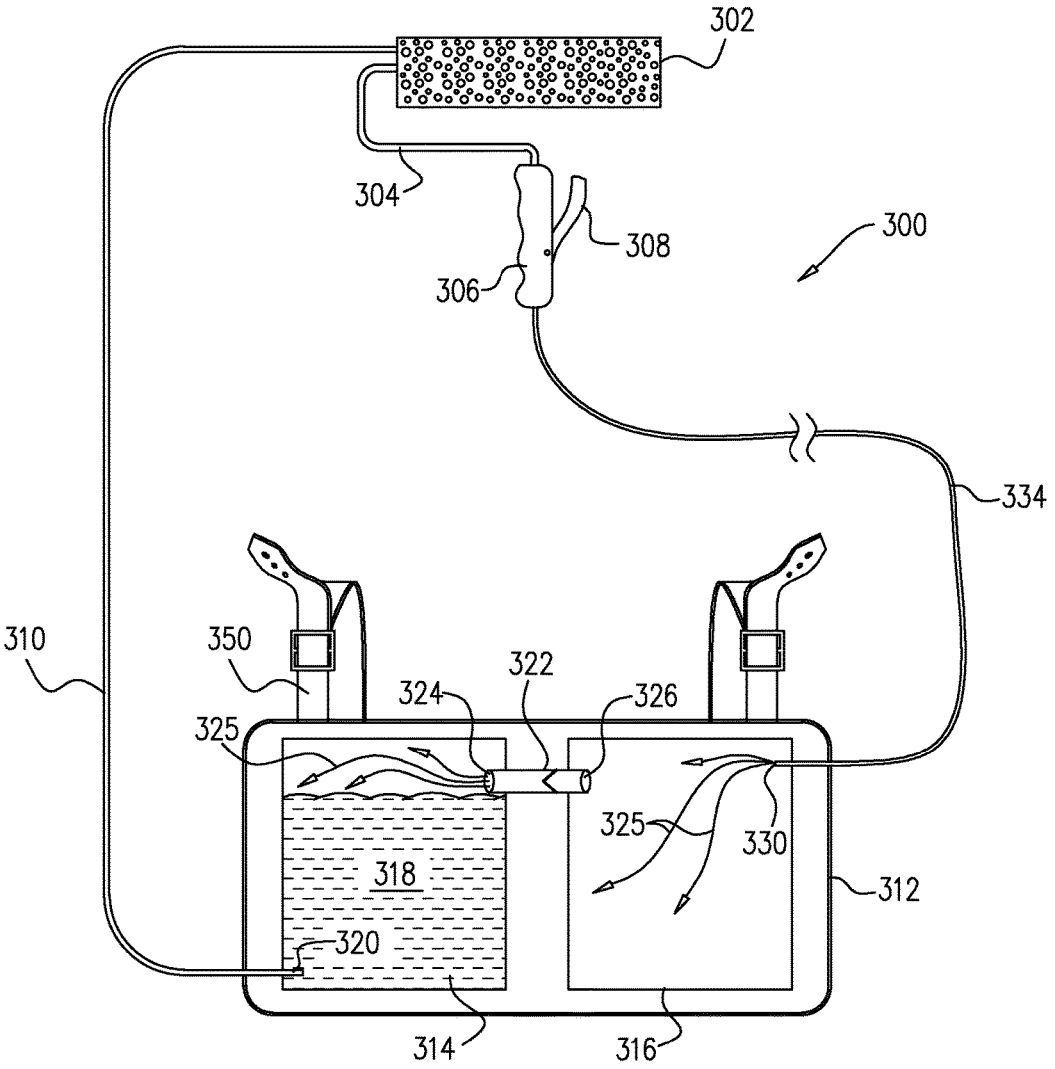

FIG. 3B shows another exemplary embodiment of the painting apparatus 300, according to some exemplary embodiments of the subject matter. The mechanical pumping mechanism 308 pumps the gas 325 into the air bag 316, which enables the gas 325 in the air bag 316 to flow into the paint bag 314. The gas 325 in the air bag 316 flows through an air tube 322 into the paint bag 314. The gas 325 enters the air tube 322 through a first opening 326 and enters the paint bag 314 through a second opening 324. The pressure caused by the gas 325 entering the paint bag 314 forces paint 318 into the paint tube 310 and to the paint accessory 302.

Figure 4:
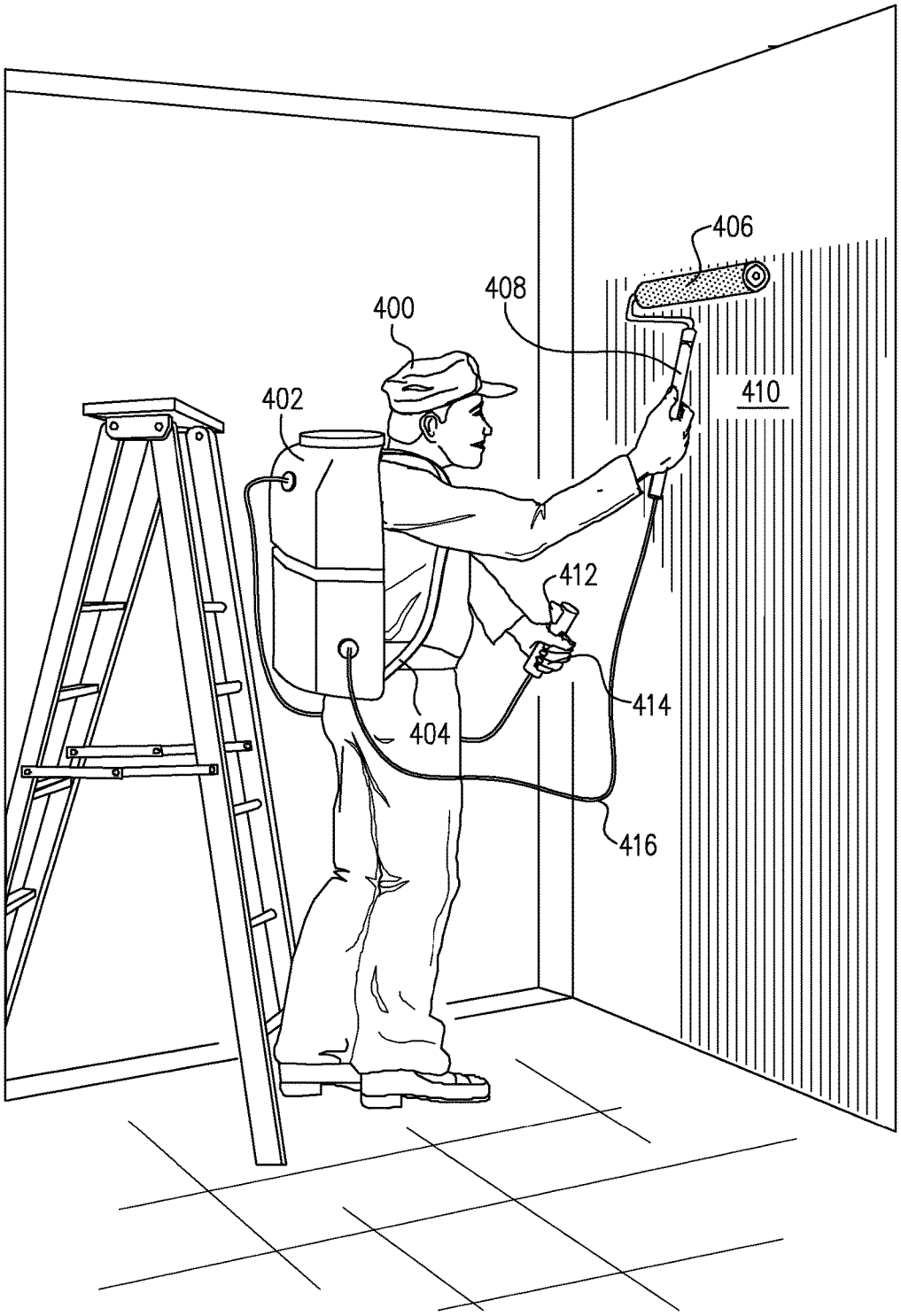
FIG. 4 shows a person using a painting apparatus, according to some exemplary embodiments of the subject matter.

FIG. 4 shows a person using a painting apparatus, according to some exemplary embodiments of the subject matter. The user 400 of the painting apparatus 402 carries the painting apparatus 402, for example, on the user's back. The painting apparatus 402 comprises shoulder straps 404 that the user 400 wears when carrying the painting apparatus 402. The user 400 holds a paint accessory 406, for example a paint roller, of the painting apparatus 402 in his hand. The paint accessory 406 is pressed against a surface 410, such as a wall, to distribute paint onto the surface 410. In some exemplary embodiments of the subject matter, the user 400 holds a lever 412 in a second hand 414. The lever 412 is used to control the pumping action which is configured to push gas from the air bag 316 of FIG. 3 into the paint bag 314 of FIG. 3. The air entering the paint bag pushes paint through a paint tube 416 to the paint accessory 406. Using air to control the flow of the paint to the paint accessory 406 enables the continuous painting with the paint accessory 406 while providing paint such that the user 400 does not have to stop painting in order put paint onto the paint accessory 406. The use of a control to control the pumping action can be applied to the other embodiments of the subject matter. Such control can be mechanical, such as a lever with a spring, electric, such as a button to turn off an electrical pump or the like.

Figure 5:
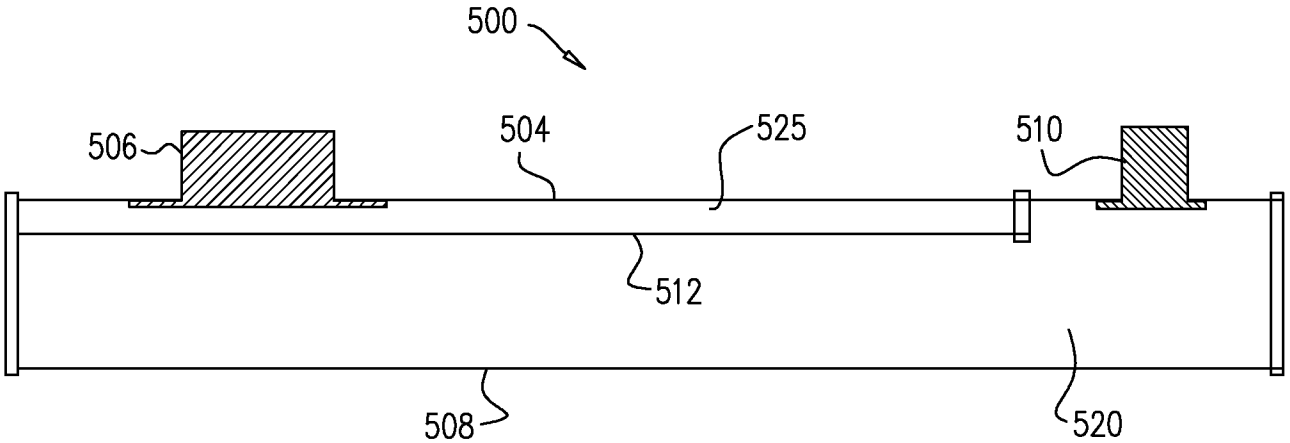
FIG. 5 shows a side view schematic layout of a painting apparatus, according to some exemplary embodiments of the subject matter.

FIG. 5 shows a side sectional and schematic view layout of a painting apparatus, according to some exemplary embodiments of the subject matter. The paint apparatus comprises a compartment 500 that includes two separate sub compartments, a first sub compartment is a paint bag 525 and a second sub compartment is an airbag 520, which may be partitioned by a single separation wall or membrane 512. The compartment 500 comprises a paint port 506 on a top layer 504. The top layer 504 is a membrane of the paint bag 525 of the compartment 500. A bottom membrane 508 of the compartment 500 comprises an air port 510. The bottom membrane 508 is a portion of the airbag 520 of the compartment 500. A separation wall or membrane 512 separates the paint bag 525 and the airbag 520. The separation wall or membrane 512 may be composed of an elastic or flexible material, such as rubber, elastic polymer, plastic or nylon film, or the like. In some embodiments of the subject matter, the separation wall or membrane 512 may comprise two layers which are connected there between in some or throughout its length. The envelope of compartment 500 may be a single bag or cover unit that include several sections or portions, e.g. bottom membrane 508 and top layer 504 may be two portions of a single bag that makes up compartment 500.

In some non-limiting embodiments, the air bag 520 and the paint bag 525 are connected together via the separation wall or membrane 512 without an external cover or structure, e.g. without having the compartment 500 to envelope the air bag 520 and the paint bag 525. The air bag 520 and the paint bag 525 are inseparable. In some cases, the air bag 520 and the paint bag 525 are manufactured as a single bag with that includes therein the air compartment and the paint compartment. An internal division within the bag separates the air compartment from the paint compartment, e.g. the separation wall or membrane 512 separates between the air bag 520 and the paint bag 525.

As gas enters the air port 510, the airbag 520 expands applying pressure via the separation wall 512 onto the paint bag 525. As the separation wall 512 pushes and compresses space in the paint bag 525 paint exits the paint bag through the paint port 506.

Figure 6A:
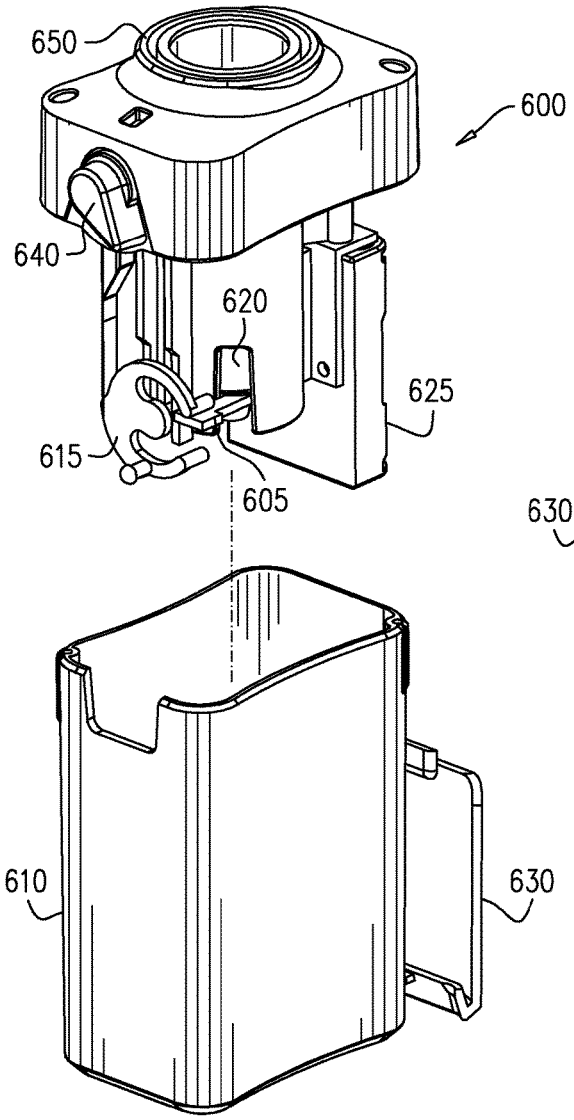
FIGS. 6A-6B show a mechanical pump for filling an airbag of a painting apparatus, according to some exemplary embodiments of the subject matter.
Figure 6B:
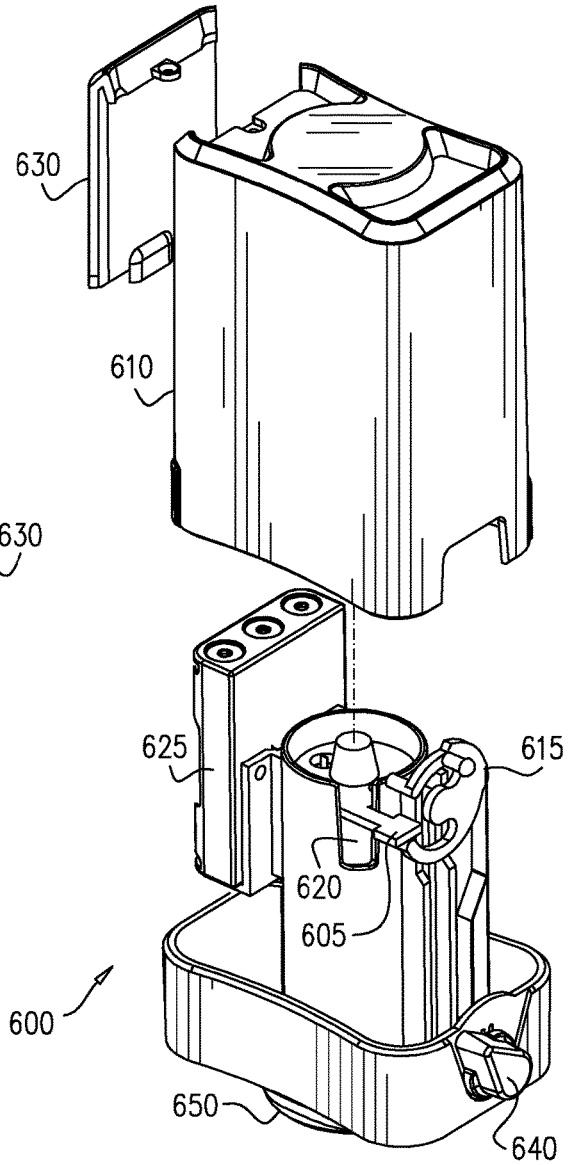

FIGS. 6A-6B show a pump device for filling an airbag of a painting apparatus, according to some exemplary embodiments of the subject matter. The painting apparatus 500 of FIG. 5 comprises an air port 510 of FIG. 5 through which air enters the air bag 520 of FIG. 5. The pump device 600 is connected to the air port 510, for example pump port 650 includes grooves and is applied to the air port 510 through a rotating motion as a plug. The pump device 600 is comprises a pump port 650, which is inserted into or connected with the air port 510 such that the pump port 650 seals the air port 510 and prevents gas from leaking out of the air port 510. The pump device 600 may comprise a button 630 for opening and closing a lid 610 of the pump device 600. The pump device 600 comprises an electrical pump 620, which pumps air into the air port 510. The pump device 600 comprises an energy source 625, for example batteries, which powers the electrical pump 620. The power source 625 may be replaceable when it runs out of power, i.e. batteries. When the power source must be replaced, the lid 610 is removed to enable access to the power source 610 to remove old batteries and insert new ones. The pump device 600 comprises an activation switch 640, which enables a user of the painting apparatus 500 to activate the pump device 600 when the user is painting. In some cases, the activation switch 640 is a flip-flop switch, which turns on or off the pump device 600. The pump device 600 comprises a pressure control mechanism 605, which measures the gas pressure of the gas pumped through the electrical pump 620 into the air port 510. The pressure control mechanism 605, may be a mechanical unit which moves as the gas pressure decreases in the air bag 520, for example moving down. In some non-limiting cases, the pressure control mechanism 605 may comprise a sensor (not shown) indicating the gas pressure at the air port 510. The pump device 600 comprises an electric switch 615, which activates and deactivates the electrical pump 605 according to the pressure measured by the gas pressure control mechanism 620. As the pressure in the air bag 520 decreases, the pressure control mechanism 620 moves a predetermined distance to indicate a reduction of the gas pressure in the air bag 520. When the pressure control mechanism reaches 620 moves a predetermined distance, the electric switch 615 activates the electric pump 620. For example, the pressure control mechanism 620 moves the predetermined distance of 10 mm, which indicates that the gas pressure in the air bag 520 is lower than a predetermined pressure, such as 0.3 ppm. The electric switch 615 activates the electrical pump 605, causing air to flow into the air bag 520. The air flowing into the air bag 520 increases the gas pressure in the air bag 520 resulting in the pressure control mechanism 605 moving to as pressure control mechanism's starting location. When the pressure control mechanism 620 reaches the pressure control mechanism's starting location, the electric switch 615 deactivates the electrical pump 605, thus stopping the flow of gas through the air port 510. The pressure within the air bag 520 reduces when paint exits the air bag 520 allowing more space for the air bag 520 to expand thereto and hence the pressure in the air bag 520 decreases as paint exists through paint port 506 of FIG. 5.

In some cases, the volume of gas in the air bag 520 remains fixed at the volume which the pump 600 pumped into the air bag 520, also when the pump stops pumping air into the air bag 520. As paint flows out of the paint bag 525 of FIG. 5 towards the paint roller, the pressure in the paint bag 525 is reduced thus reducing the pressure applied to the air bag 520. When the pressure applied to the air bag 520 is reduced, e.g. to a pressure level lower than a predetermined threshold level, the pump 600 is automatically reactivated to increase the pressure to the desired pressure range, e.g. between 0.18-0.2.

Figure 7A:
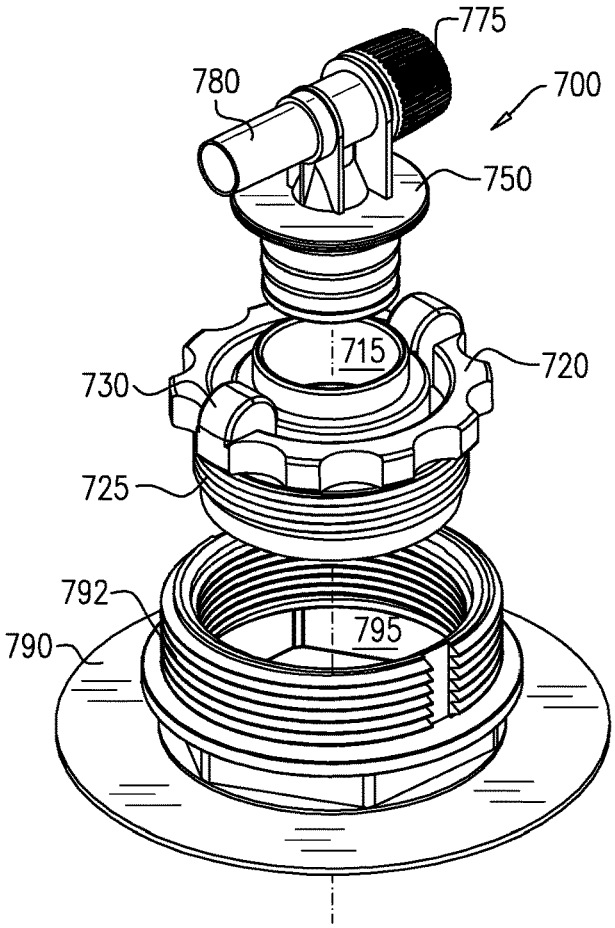
FIGS. 7A-7B show a stopper for a paint opening of a painting apparatus, according to some exemplary embodiments of the subject matter.

FIG. 7A shows a stopper for a paint opening of a paint apparatus, according to some exemplary embodiments of the subject matter. The stopper 700 is a cover of a paint port 790, which provides a convenient arrangement for attaching the paint tube 218 of FIG. 2, while sealing the paint port 790 to prevent spillage of the paint from the paint bag 525 of FIG. 5. The stopper 700 enables the optimal volume of the paint to exit the paint bag 505 while the painting apparatus 500 of FIG. 5 is in use. The stopper 700 comprises an external stopper 720, which is inserted into a port 795 of the paint port 790. The external stopper 720 may be inserted into the port 795 the paint port 790 using a rotating motion, such as screwing the external stopper into the paint port 790. The external stopper comprises a stopper port 715, through which paint base is filled into the paint bag 525. After the paint bag is filled with the paint base, an internal stopper 750 is inserted into the stopper port 715. The internal stopper 750 is molded to fit into a stopper port 715 of the external stopper 720 such that the internal stopper 750 cannot be removed from the stopper port 715, so to prevent excess spillage of paint from attempts of a user to remove the internal stopper 750. The internal stopper 750 is fitted into the stopper port 715 by the internal stopper 750 being pushed into the stopper port 715 such that the internal stopper 750 cannot be removed from the stopper port 715. The internal stopper 750 is inserted into the stopper port 715 after a paint base is poured into the paint bag 525 dining production of the painting apparatus 500.

The internal stopper 750 comprises a paint valve 770, which enables paint to flow out of the paint bag 525 into the paint tube 218. The paint valve 770 comprises a valve paint tube 780, which is inserted into the paint tube 218, to enable the paint to flow into the paint tube 218 without causing a leak. When the paint tube 218 is connected to the valve paint tube 780, the paint flowing through the valve paint tube 780 flows into the paint tube 218, which flows the paint to the paint accessory 220 of FIG. 2. The paint valve 770 comprises a valve knob 775, which enables controlling the amount of paint that flows through the paint valve 770 into the paint tube 218. The valve knob 775 enables closing the paint valve 770 to enable attachment or removal of the paint tube 218 without causing spillage of the paint from the paint bag 525. The closing of the paint valve 770 further enables easily transporting the painting apparatus 500 without having the paint tube 218 and paint accessory 220 connected to the painting apparatus 500, and without paint leaking out of the paint bag 525.

The external stopper 720 comprises a spiral molding 725, such as grooves, to enable screwing or inserting the external stopper 720 into the paint port 790 though a circular or rotation motion. The external stopper 720 is inserted into the paint port 790 by rotating the external stopper 720 into the paint port 790 until the external stopper 720 is tightly connected to the paint port 790. When the user purchases the painting apparatus 500, the user selects a color with which to paint. Paint pigment is then added to the paint base already in the paint bag 790. The stopper 700 is removable from the paint port 790 when paint color is added to the paint base already in the paint bag 525. Once the paint pigment is added, the stopper 700 is tightly inserted back into the paint port 790 using a rotating motion, i.e. twisting motion, to enable mixing the contents of the paint bag 525 to make the paint ready for use. The mixing is performed using a paint mixer. To prevent paint from spilling from the paint bag 525, the stopper 700 is tightly inserted into the paint port 790. Once the mixing is performed, the painting apparatus 500 is prepared to be used for painting.

Figure 7B:
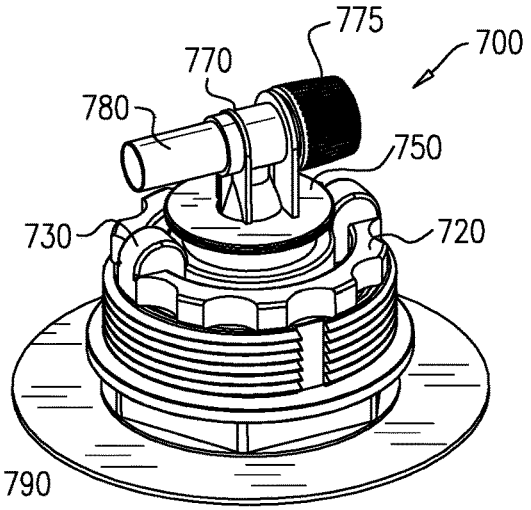

FIG. 7B shows the internal stopper 750 inserted into the external stopper 720, according to some exemplary embodiments of the subject matter. The internal stopper 750 is inserted into the external stopper 720 by applying a strong force to insert the internal stopper 750 into the external stopper port 715. It should be noted that insertion of the internal stopper 750 into the external stopper 720 occurs during production of the painting apparatus 500 after which the internal stopper 750 cannot be removed from the external stopper 720. The internal stopper 750 cannot be removed and prevents any leaking of the paint from the external port 720.

Figure 8A:
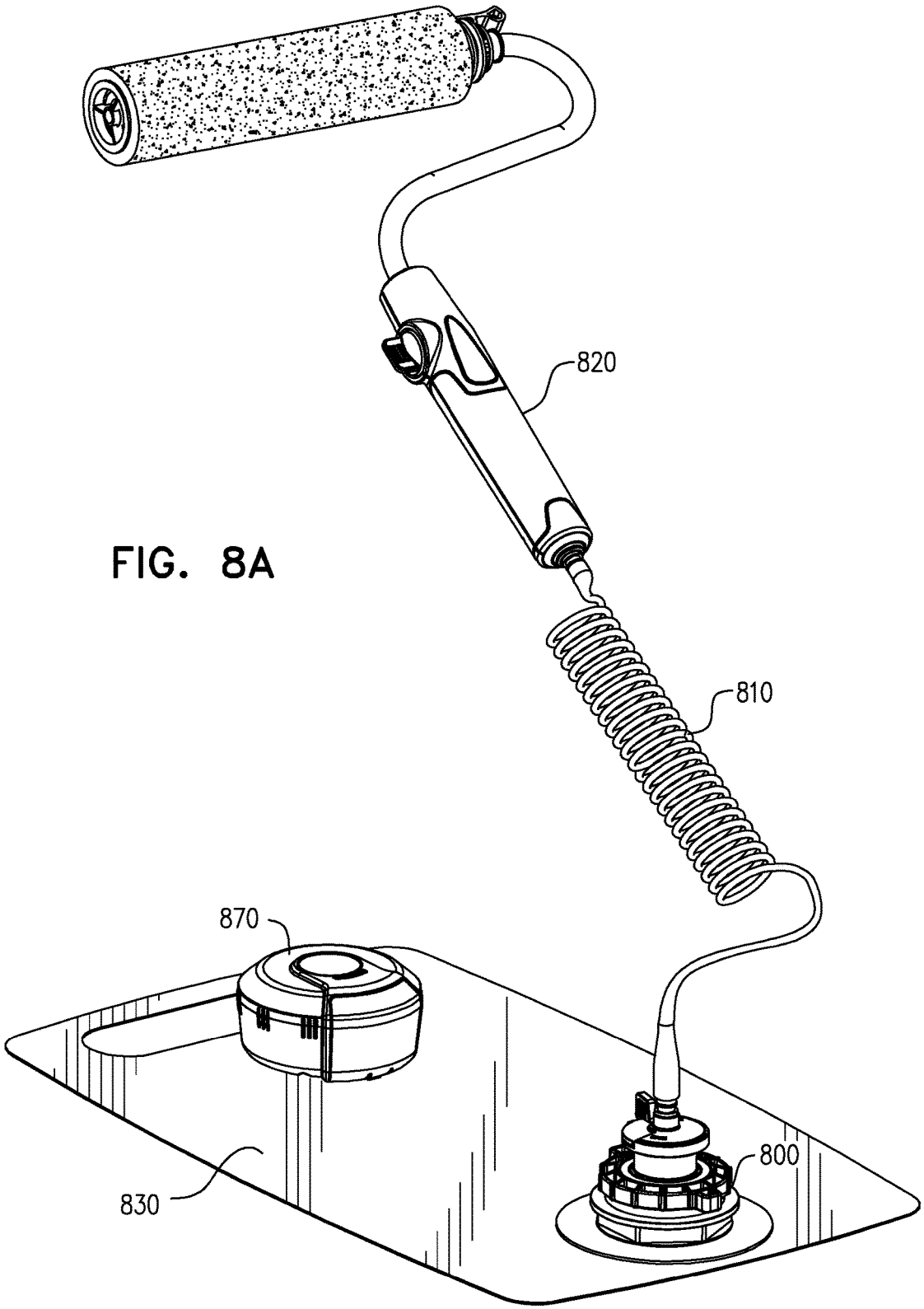
FIGS. 8A-8B are schematic illustrations of a faucet connectable to a paint roller of a painting apparatus, according to some exemplary embodiments of the subject matter.
Figure 8B:
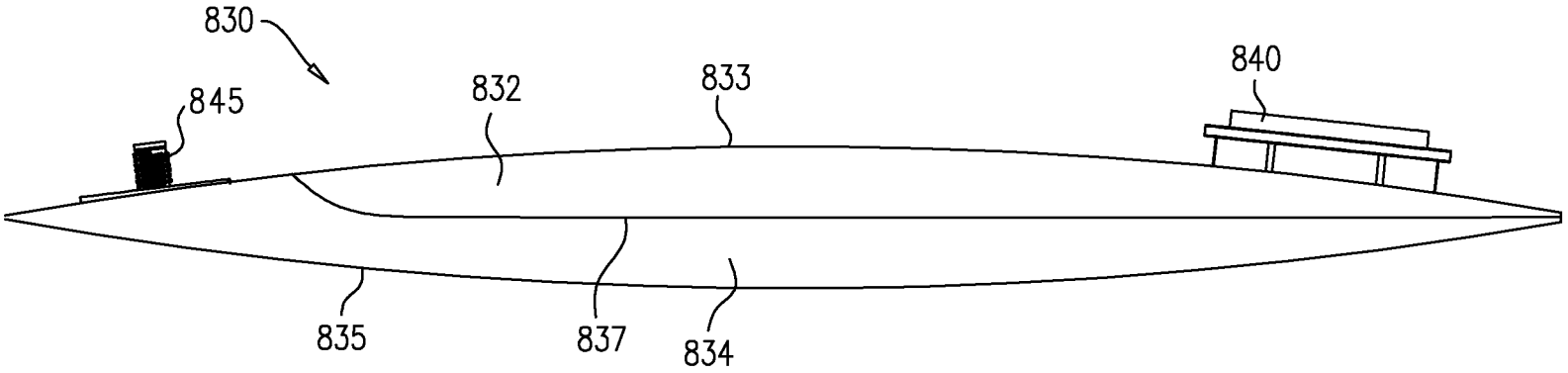

FIGS. 8A-8B are schematic illustrations of a faucet connectable to a paint roller of a painting apparatus, according to some exemplary embodiments of the subject matter. The inner layer of the paint bag 832 of painting apparatus 830, as well as the faucet 800 connected to the paint bag, which come in contact with the paint, may be composed of a material which prevents the paint from sticking to the walls of the paint bag 832 of painting apparatus 830. Such material enables using the painting apparatus 830 for long periods of time, during which the user may pause or stop the painting process, and resume it at a later time. During the pauses, or the periods of time that the painting apparatus 830 is not used, the material of the inner layer of the paint bag prevents the paint from drying or coagulating, thus enabling the user to resume the painting process at a later time with no need to replace the paint stored in the painting apparatus or the paint bag. For example, the faucet 800 may be comprised of or covered with a layer of acetyl, Teflon, or the like, to prevent paint from sticking to it.

Furthermore, the faucet may be comprised of or covered with a material that adheres to the nylon e.g. by melting, soldering, welding or fusing the material with the paint bag 832.

The faucet 800 may be inserted into a paint port of a painting apparatus 830 to control the flow of paint out of the painting apparatus 830 towards the paint roller 820. The faucet 800 is removable from the paint port 840, for example for adding substances into the paint bag 832, e.g. adding water or solvent for diluting the paint, or adding a paint pigment to a paint base color that may be provided or available in the paint bag 832.

The faucet 800 is connectable to the paint roller 820 via a paint tube 810. In some exemplary embodiments of the subject matter, the paint tube 810 may be disconnected from the faucet 800 and the paint roller 820 for maintenance and cleaning of the paint tube 810. The paint tube 810 is composed of a flexible polymer material. In some non-limiting embodiments, the paint tube 810 is extendible, to enable the user to paint from a certain distance from the painting apparatus without needing to carry the painting apparatus 830 with the user. The paint apparatus 830 is connectable to an electronic pump 870 via an air port 845, which pumps air into the air bag 834 of the painting apparatus 830.

The painting apparatus 830 is constructed from a first wall 833 connected to a second wall 835, for example, via melting, welding, fusion, or the like. The internal section of the painting apparatus 830 is divided into the paint bag 832 and the air bag 834 via a separation wall or membrane 837. The painting apparatus 830 and its internal divisions are constructed to enable withstanding pressure of at least a predetermined threshold range, e.g. between 0.18-0.2 bars. For ensuring safety, the painting apparatus 830 may be designee to withstand a threshold of at least 0.7 bars to prevent injuries to users and bystanders.

The separation wall or membrane 837 may be a single layered substrate, composed of, e.g. a polyester or polyethylene, of a predetermined thickness e.g. ranging between 150-170 microns or 100-250 microns. The separation wall or membrane 837 is elastic and/or flexible.

The first wall 833 and the second wall 835 may comprise a multi-layered substrate. The first layer of the first wall 833 and the second wall 835 may be composed of a polyamide, such as polyester of a certain thickness (e.g. 12 microns, or in a range of 10-20 microns). A second (middle) layer of may be composed of a nylon of a predetermined thickness, e.g. 15 microns). A third layer, which is the internal layer of the painting apparatus 830, and which comes in contact with the paint stored therein, may comprise a material that does not stick to the paint and prevents it from coagulating or drying, e.g. polyethylene of a certain thickness (e.g. 180 microns, or in the range of 120-250 microns), or the like.

The separation wall or membrane is connected to the first wall 833 and/or to the second wall 835 via melting welding, fusing or the like. The materials composing the inner layer of the first wall 833, the second wall 835, and the separation wall or membrane 837 are designed to allow welding, fusion, or melting.

Figure 9A:
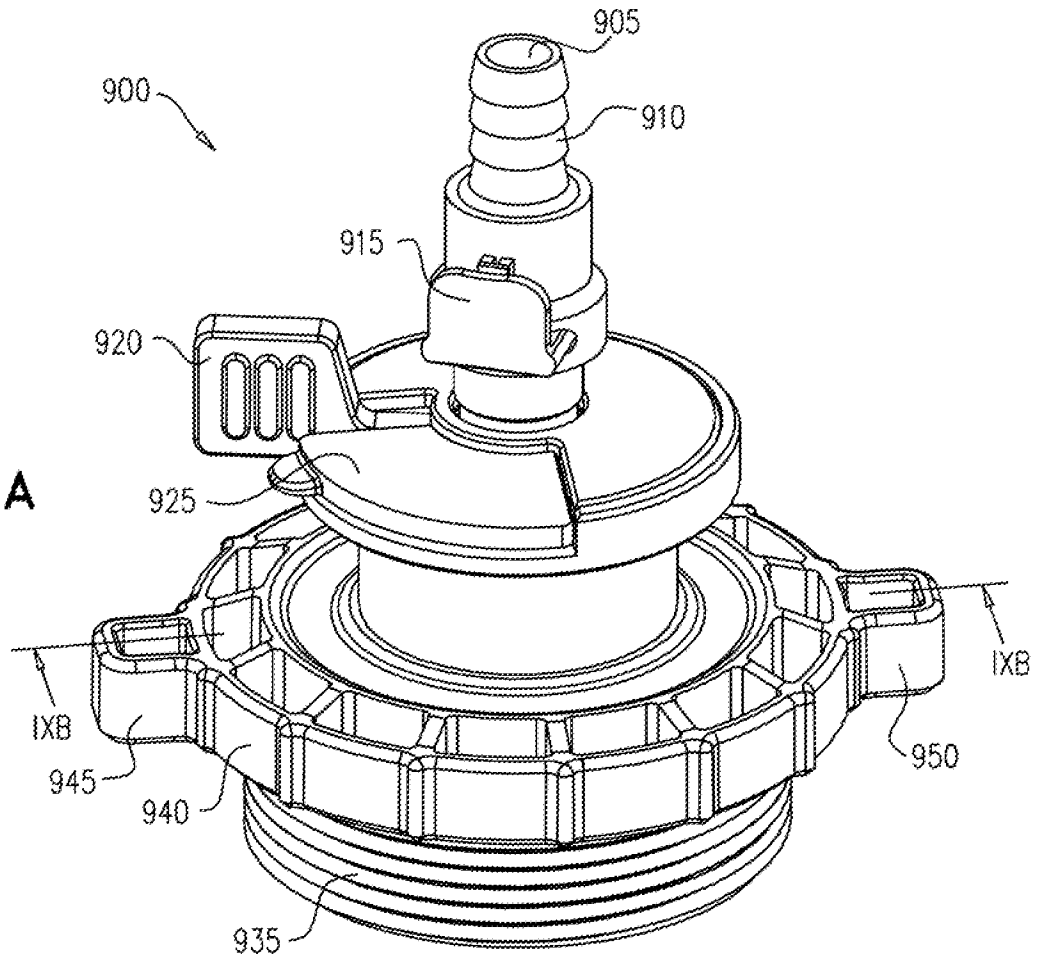
FIG. 9A-9B are schematic illustrations of a faucet and a cross section thereof, according to some exemplary embodiments of the subject matter.
Figure 9B:
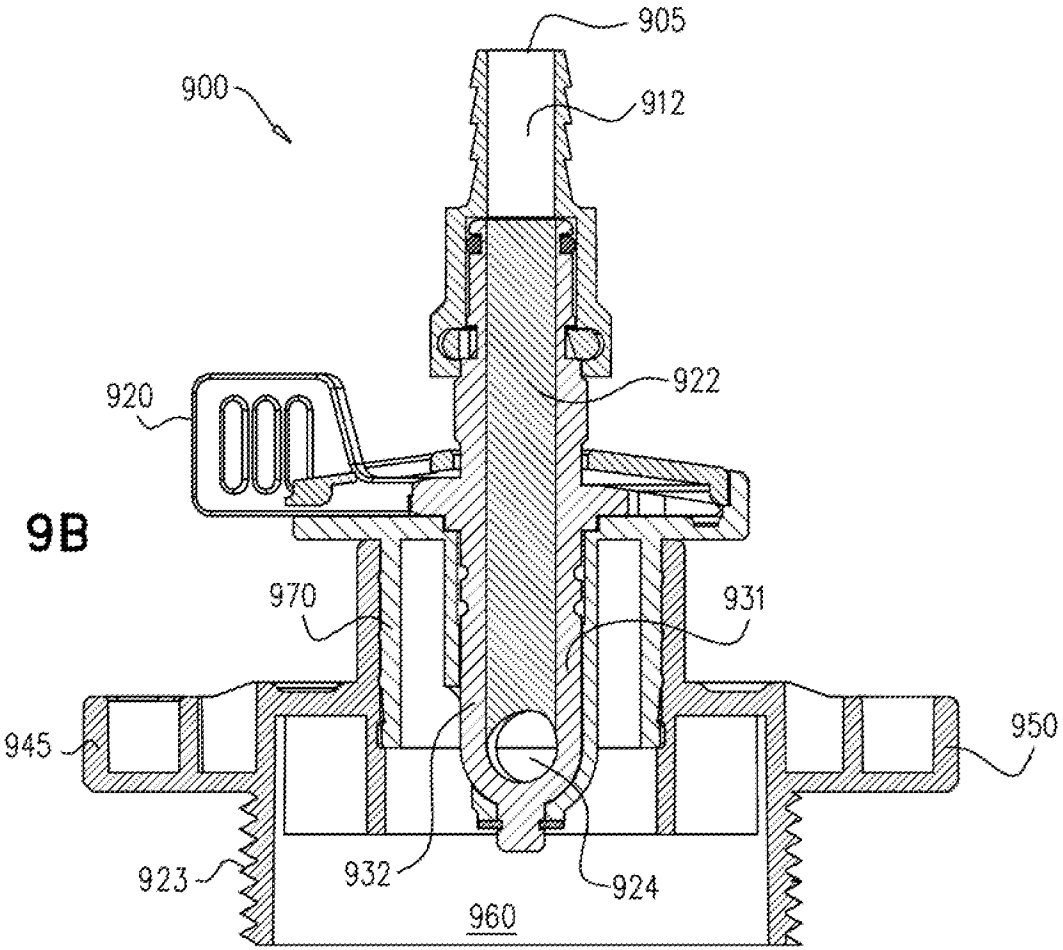

FIG. 9A-9B are schematic illustrations of a faucet and a cross section thereof, according to some exemplary embodiments of the subject matter. FIG. 9A is a schematic illustration of the faucet 800, according to some exemplary embodiments of the subject matter. The faucet 800 provides a convenient arrangement for attaching the paint tube 810 of FIG. 8A, while sealing the paint port 840 of FIG. 8B to control the flow of the paint from the paint apparatus 830 of FIG. 8A to the paint roller 820 of FIG. 8A.

The faucet 800 comprises an external mold 940, which is attached to the paint port. The external mold 940 may comprise one or more latches 935 to rotatably insert or connect the faucet 800 into the paint port 840. The external mold 940 comprises one or more handles, for example, a first handle 945 and a second handle 950. The one or more handles provide a grip for the user to easily rotate the faucet 800, in order to insert or remove the faucet 800 from the paint port 840. For example, by applying a rotation force onto the one or more handles, faucet 800 may be connected to or inserted into the paint port 840.

An internal mold 970 may be inserted into the external mold 940, e.g. by applying a certain force (e.g. above a predetermined threshold) to insert the internal mold 970 into the external mold. In some embodiments, insertion of the internal mold 970 into the external mold 940 occurs during production of the painting apparatus 830, and the insertion may not be reversible. For example, after insertion of internal mold 970 into the external mold 940, the internal mold 970 may not be removable from the external mold 940, thus preventing leaking of paint from the external mold 940.

The internal mold 970 comprises a faucet valve 910, which is inserted into the paint tube 810 of FIG. 8 to enable the paint to flow from the painting apparatus 830 into the paint tube 810 and to the paint roller 820. In some cases, the faucet valve 910 is rimmed to prevent the paint tube 810 from slipping off of the faucet valve 910.

The paint valve 910 comprises a clasp 915, which is used to connect the paint tube 810 to the faucet 800, and prevent the paint tube 810 from slipping off the faucet valve 910. The faucet valve 910 comprises a valve opening 905, from which the paint flows into the paint tube 810.

The internal mold 970 comprises a faucet lever 920 to control the flow of paint through the faucet valve 910. The internal mold 970 is molded during production of the faucet 800 and includes a removable portion 925, which may be broken off to enable movement of the faucet lever 920. The removable portion 925 may be for example a chip (e.g. a plastic chip), and may prevent the lever 920 from moving and accidentally opening the faucet valve 910, thus preventing paint from accidentally or unintentionally flowing or spilling through the valve opening 905 prior to a first use of the paining apparatus 830. The removable portion 925 may be configured for a one-time use, e.g. may not be re-attachable to the internal mold 970 after it is broken or removed.

FIG. 9B is a schematic illustration along an IXB axis of a cross section of the faucet 800, according to some exemplary embodiments of the subject matter. The external molding 940 comprises a cavity 960, which receives the paint from the paint hag 525 of FIG. 5.

The faucet lever 920 is connected to a faucet conduit 931, through which paint flows to the faucet valve 910. The faucet conduit 931 comprises a conduit cavity 922 through which paint flows from a conduit opening 924 to the faucet valve 910. The faucet conduit 922 is connected to the faucet lever 920 to enable controlling the flow of the paint into the conduit cavity 922. For example, the user moves the faucet lever 920, which causes the conduit opening 924 to rotate and become aligned with an internal opening 932, to enable paint to flow into the conduit cavity 922.

When the faucet lever 920 is rotated to stop paint from flowing into the conduit cavity 922, the conduit opening 924 is misaligned with the internal opening 932. The internal opening 932 is molded as a portion of the internal mold 970. In some cases, the internal mold 970 comprises one or more grooves 923, which fix or hold the faucet conduit 931 in a stationary position within the internal mold 970.

Figure 10A:
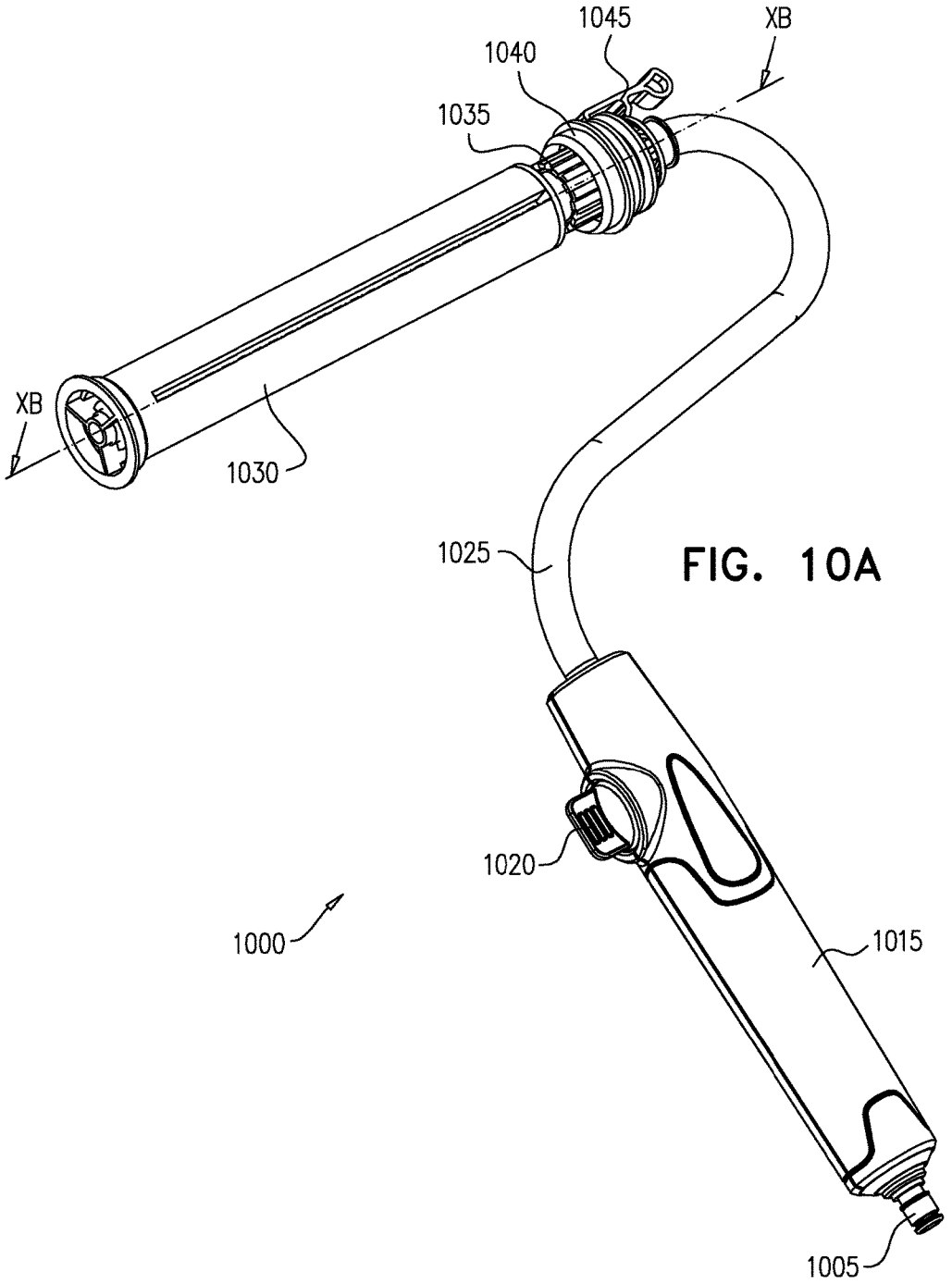
FIG. 10A-10B are schematic illustrations of a paint roller of a painting apparatus and a cross section thereof, according to some exemplary embodiments of the subject matter.
Figure 10B:
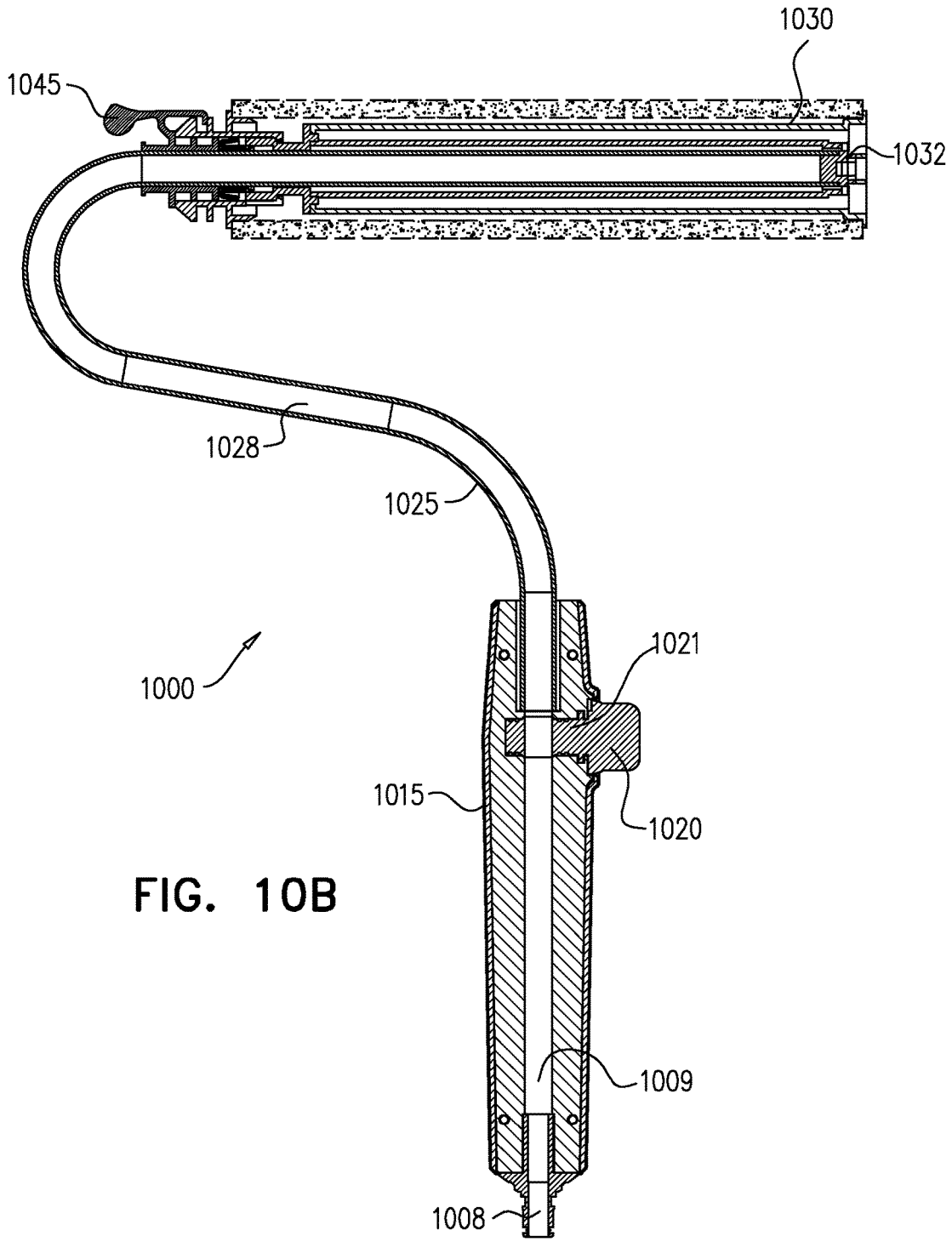

FIG. 10A-10B are schematic illustrations of a paint roller of a painting apparatus and a cross section thereof, according to some exemplary embodiments of the subject matter. FIG. 10A is a schematic illustration of the paint roller 1000, according to some exemplary embodiments of the subject matter. The paint roller 1000 comprises a handle 1015, which is used by a user to hold the paint roller 1000 for painting. The handle 1015 is connected to a frame 1025, which connects the handle 1015 to a foam cage 1030. The foam cage 1030 enables attaching a foam roll 1050 of FIG. 10B. The paint roller 1000 comprises a paint roller connector 1005, which connects to the paint tube 810 of FIG. 8.

The paint roller 1000 comprises a roller clip 1045, which clasps onto the foam roll 1050 to prevent the foam roll from falling off of the roller cage 1030. The paint roller 1000 comprises a flow control dial 1020, which enables the user of the paint roller 1000 to control the amount of paint that flows from the painting apparatus 830 to the foam roll 1050, and to control the saturation of the foam roll 1050.

FIG. 10B is a schematic illustration along an XB axis of a cross section of the paint roller 1000, according to some exemplary embodiments of the subject matter. A foam roll 1050 is attached to the foam cage 1030. The handle 1015 comprises a handle tube, which conducts the paint flow from the paint connector 1005 to a flame tube 1028. The frame tube 1028 is located within the frame 1025 of the paint roller 1000. The flow control dial 1020, which is connected to the handle 1015, controls the rotation of a roller faucet 1021 to control the amount of paint or speed of flow of the paint through the handle tube 1009. The paint flows through frame tube 1028 to a dispensing port 1032, which dispenses the paint onto the foam roll 1050. The dispensing port 1032 is located in the foam cage 1030 so as to evenly dispense the paint onto the foam roll 1050, and to enable evenly or uniformly painting a surface.

Figure 11:
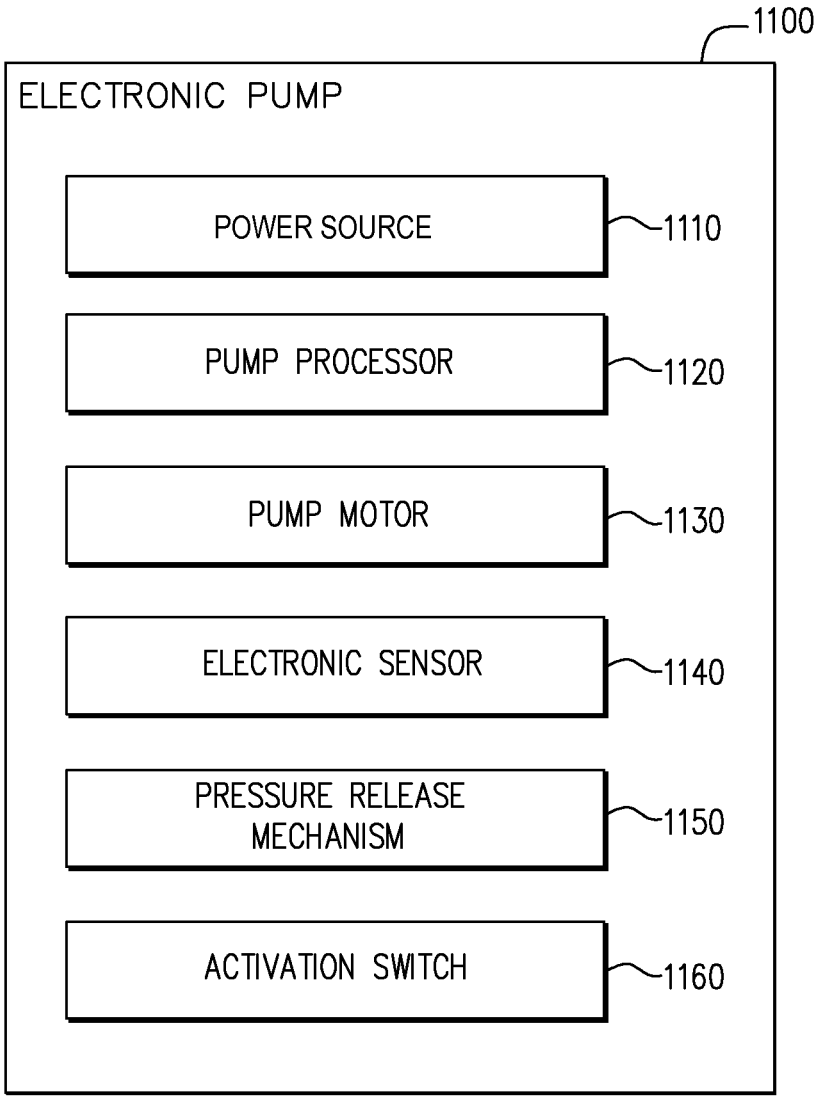
FIG. 11 is a schematic illustration of an electronic pump for filling an airbag of a painting apparatus, according to some exemplary embodiments of the subject matter.

FIG. 11 is a schematic illustration of an electronic pump for filling an airbag of a painting apparatus, according to some exemplary embodiments of the subject matter. The electronic pump 1100 is connected to the air port 510 of FIG. 5. The electronic pump 1100 comprises an energy source 1105, for example batteries or an electricity outlet, which provide power to the electronic pump 1100. The power source 1110 may be replaceable when it runs out of power, e.g. batteries or rechargeable batteries. The electronic pump 1100 comprises an activation switch 1160, which enables a user of the painting apparatus 500 of FIG. 5 to activate the electronic pump 1100. For example, the activation switch 1160 is a push-button, which activates the electronic pump 1100.

The electronic pump 1100 comprises a pump processor 1120, which manages and controls the performance of the components of the electronic pump 1110. The controller may include a processing unit, and may be operationally connected to all electrical components of the electronic pump 1100 in order to control these components, or receive data from them.

The electronic pump 1100 comprises a pump motor 1130, which pumps air into the air port 510. The electronic pump 1100 comprises an electronic sensor 1140, which measures the pressure in the air bag 520 of FIG. 5.

The electronic sensor 1140 continuously measures or samples the pressure in the air bag 520, for example in a predetermined number of times per minute or per second. When the air pressure measured by the electronic sensor

1140 reaches a predetermined low pressure threshold or threshold range, for example, 0.12 bars or lower, the pump controller 1110 may cause activation of the motor 1130 to pump air into the air bag 520. When the air pressure measured by the pressure sensor 1140 reaches or surpasses a predetermined high pressure threshold (or threshold range), for example 0.18 bars or 0.2 bars, the pump controller 1110 deactivates the motor 1130.

In some exemplary embodiments of the subject matter, the electronic pump 1100 comprises a pressure release mechanism 1150, which enables safe and gradual release of pressure in the air bag 520 when a user removes the electronic pump 1100 from the air port 510. For example, the pressure release mechanism 1150 may include a screw which gradually releases the pressure before the electronic pump 1100 is disconnected from the air port 510.

The electronic pump 1100 may be reusable with multiple painting apparatuses, by disconnecting the electronic pump 1100 from the air port 510 of one painting apparatus and attaching it the air port 510 of a second painting apparatus. To ensure that the user does not get injured from the pressure release when the electronic pump 1100 is removed from the air port 510, the pressure release mechanism 1150 enables a controlled release of the air out of the air bag 520.

While the disclosure has been described with reference to exemplary embodiments, it will be understood by those skilled in the art that various changes may be made and equivalents may be substituted for elements thereof without departing from the scope of the subject matter. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this subject matter, but only by the claims that follow.

The invention claimed is:

1. A faucet inserted into a paint port of a painting apparatus to control flow of paint removed from the painting apparatus, the faucet comprising:

an external mold rotatably insertable into the paint port; wherein said external mold comprises one or more grooves enabling the rotatable insertion of the faucet into the paint port;

a faucet conduit comprising a conduit cavity and a conduit opening which is perpendicular to the conduit cavity;

an internal mold insertable into the external mold, said internal mold comprises an internal opening, wherein the internal opening is perpendicular to the conduit cavity;

a faucet valve to control flow of paint from the paint apparatus, said faucet valve comprises a faucet lever to control the flow of paint through the faucet conduit;

wherein the conduit cavity is configured to facilitate paint flow to the faucet valve, and wherein the conduit opening becomes aligned with the internal opening upon rotation of the faucet lever; and a removable portion to prevent the faucet lever from opening the faucet valve prior to a first use of the painting apparatus, said faucet lever controls flow of paint through the faucet valve; wherein said removable portion is molded to be a part of the internal mold, said removable portion is shaped as an arch and prevents the faucet lever from moving, forcing the faucet lever to stay on one side of the removable portion;

wherein the faucet valve includes a clasp to prevent a paint tube from slipping off of the faucet valve.

2. The faucet of claim 1, further comprising a paint roller, wherein the faucet valve controls flow of paint from the paint apparatus to the paint roller.

3. The faucet of claim 2, wherein tote paint tube is connected to the faucet opening to enable paint to flow from the painting apparatus to the paint roller.

4. The faucet of claim 1, wherein the external mold comprises one or more handles to provide a grip for a user to rotate the faucet.

5. The faucet of claim 1, wherein the faucet is composed of a composition comprising acetyl, Teflon, or a combination thereof thereby preventing the paint from sticking to the walls of the faucet, wherein the composition prevents the paint from drying or coagulating.

6. The faucet of claim 1, wherein the faucet is disposable.

* * * * *